US005440320A

United States Patent [19]

Lach et al.

[11] Patent Number: 5,440,320

[45] Date of Patent: Aug. 8, 1995

[54] ANTENNA REFLECTOR RECONFIGURABLE IN SERVICE

[75] Inventors: Olivier Lach, Les Mureaux; Serge Schenck, Sartrouville, both of France

[73] Assignee: Aerospatiale, Societe Nationale Industrielle, France

[21] Appl. No.: 292,607

[22] Filed: Aug. 18, 1994

Related U.S. Application Data

[63] Continuation of Ser. No. 893,685, Jun. 5, 1992, abandoned.

[30] Foreign Application Priority Data

Jun. 19, 1991 [FR] France ..... 91 07534

[51] Int. Cl.[6] ..... H01Q 15/14; H01Q 15/20

[52] U.S. Cl. ..... 343/915; 343/912

[58] Field of Search ..... 343/915, 912, DIG. 2, 343/DIG. 1, 897, 908, 878, 882, 880, 914; H01Q 15/14, 15/20

[56] References Cited

U.S. PATENT DOCUMENTS

| | | | |
|---|---|---|---|
| 2,945,234 | 7/1960 | Driscoll | 343/915 |
| 4,092,453 | 5/1978 | Tonda | 343/897 |
| 4,750,002 | 6/1988 | Kommineni | 343/915 |
| 4,905,607 | 3/1990 | Wanneroy | 105/8.1 |
| 4,989,015 | 1/1991 | Chang | 343/915 |
| 5,162,811 | 11/1992 | Lammers et al. | 343/915 |

FOREIGN PATENT DOCUMENTS

| | | |
|---|---|---|
| 0290124 | 11/1988 | European Pat. Off. . |
| 8901708 | 2/1989 | WIPO . |

OTHER PUBLICATIONS

18th European Microwave Conference 88, Sep. 1988, pp. 482–487.

Electronics Letters, vol. 27 No. 1, Jan. 3, 1991, pp. 65–65.

Microwave Engineering Europe, Jun., 1991, p. 15.

*Primary Examiner*—Donald Hajec

*Assistant Examiner*—Hoanganh Le

*Attorney, Agent, or Firm*—Remy J. VanOphem; John VanOphem

[57] ABSTRACT

An in-service reconfigurable antenna reflector having a rigid support structure, a deformable reflective surface having radio reflection properties and actuators operating on the deformable reflective surface to deform it. The reflective surface is elastically deformable with stiffness in bending and the actuators operate at control points of the deformable reflective surface, transversely thereto.

42 Claims, 7 Drawing Sheets

ANTENNA REFLECTOR RECONFIGURABLE IN SERVICE

This is a continuation of application Ser. No. 07/893,685, filed Jun. 5, 1992, now abandoned.

BACKGROUND OF THE INVENTION

1. Field of the Invention

The invention concerns a variable geometry antenna reflector adapted to provide from a spacecraft such as a satellite a transmit and/or receive coverage zone on the ground having a non-circular contour, for example a contour surrounding a country or a group of countries (see FIG. 1), that is required to be modifiable during the service life of the spacecraft. In practice this means an in-orbit reconfigurable shaped contour beam antenna reflector or, for short, an in-service reconfigurable antenna reflector.

Although the invention is primarily directed to a spacecraft application, it is to be understood that it is of more general application to any antenna reflector where it is necessary to be able to change the shaped of the beam in service without changing the reflector (large high-precision telescopes, for example).

2. Description of the Prior Art

The conventional way to obtain a shaped contour beam is to use multiple feeds illuminating a single or double offset reflector system according to an appropriate law. The beam is obtained by exciting the feed elements with optimized phase and amplitude by means of a signal forming network composed of waveguides ("beam forming network").

Another way to obtain a radiation pattern having the required contour is to use a single feed associated with a shaped surface reflector system (by which is meant a shape having a specific geometry, for example a non-quadratic geometry like that of FIG. 2). Variations in the optical pat between the feed and the various points on the reflector make it possible to generate a diagram whose phase and amplitude match the characteristics of the required radiation diagram.

Because the service life of satellites is being increased, it is becoming necessary to be able to modify the beam shape in orbit in order to compensate for variations in orbital position and to meet new service constraints. Reconfigurable antenna systems are conventionally obtained by integrating into the beam forming network power splitters and phase-shifters with variable characteristics. This renders the multiple feed highly complex which introduces radio frequency power losses, the risk of passive intermodulation products in the case of a transmit antenna, constraining thermal regulation requirements for the satellite platform and a mass penalty.

An alternative solution to the problem of reconfiguring a reflector antenna in orbit is to employ a system of one or more reflectors whose reflective surfaces are deformable so that the radiation diagram can be modified.

The feasibility of this approach has already been investigated by CLARRICOATS et al. See in particular "A reconfigurable mesh reflector antenna" by P. J. B. CLARRICOATS, Z. HAI, R. C. BROWN, G. T. POULTON & G. CRONE published in ICAP Conference, April 1989, or "The design and testing of reconfigurable reflector antennas" by P. J. B. CLARRICOATS, R. C. BROWN, G. E. CRONE, Z. HAI, G. T. POULTON & P. J. WILSON published in ESA Workshop for antenna technology, November 1989. However, the proposed concept uses a gold-plated molybdenum knitted mesh reflective surface shaped point by point using an array of strings tensioned by a system of pulleys controlled by stepper motors.

From the mechanical and geometrical points of view the deformable surface behaves like a membrane with the result that the reflective surface has numerous singularities (see FIG. 3, for example). Consequently, obtaining the precise profile required of the reflector despite such singularities calls for a large number of control points.

An object of the invention is to alleviate the aforementioned disadvantages by minimizing the presence of artifacts such as the aforementioned singularities at the surface of an in-service reconfigurable antenna.

The solution put forward for obtaining a regular surface resides in the use of a reflective and elastically deformable skin which is stiff in bending but sufficiently flexible at its interfaces with the supporting structure or the actuators to limit the deformation forces and energy.

SUMMARY OF THE INVENTION

The invention is an in-service reconfigurable antenna reflector having a rigid support structure, a deformable reflective surface with radio reflection properties and actuators operating on the deformable reflective surface to deform it, wherein the reflective surface is elastically deformable with stiffness in bending and the actuators operate at control points of the deformable reflective surface, transversely thereto.

According to possibly combinable preferred features of the invention the reflective surface which has stiffness in bending is a layer of glass fiber reinforced plastic material, and the fibers are electrically conductive.

The reflective surface is made from a composite material based on carbon fibers impregnated with a thermosetting resin. The fibers are electrically non-conductive and the plastic material layer is covered with a metal film. The metal film is deposited in a vacuum, or is adhesively bonded.

The deformable reflective surface is a flexible reflective layer supported by an elastically deformable support layer having stiffness in bending, wherein the reflective layer is fixed to the support layer by sewing or by adhesive bonding. The support layer is a grid formed by strips or wires having stiffness in bending, which grid may be formed of metal strips or wires, or of wires or strips made from fibers coated with a thermosetting or thermoplastic material. The fibers may be glass fibers, aramide fibers or carbon fibers.

The mesh size of the grid is between 10 mm and 1 m, and the grid is fixed at its periphery to the rigid support structure and the wire or strips having stiffness in bending are connected to it with at least freedom to move parallel to themselves.

The reflective layer flexible in bending may be a metalized flexible plastic material film, may be knitted from electrically conductive wire, or may be woven from electrically conductive fibers or wires.

The actuators can be piezo-electric linear actuators, or can be a rotary motor, having a lead screw and a nut cooperating with the lead screw.

The actuators are connected to the rigid support structure by universal joints, or may be joined to the reflective surface by pivoting connections with two degrees of freedom in rotation about two axes substantially parallel to the deformable reflective surface.

The reflective surface can be a reflective layer flexible in bending carried by a support layer having a stiffness in bending defined by rigid wires, wherein the support layer is a grid and the actuators operate on the deformable reflective surface at control points P which are part of the support layer and located where the wires cross. A respective actuator is associated with each wire or strip crossing, or at least some actuators are rings in which two wires or strips of the grid cross and slide freely.

Objects, features and advantages of the invention will emerge from the following description given by way of non-limiting example with reference to the appended drawings.

DETAILED DESCRIPTION OF THE INVENTION

Figure 1:
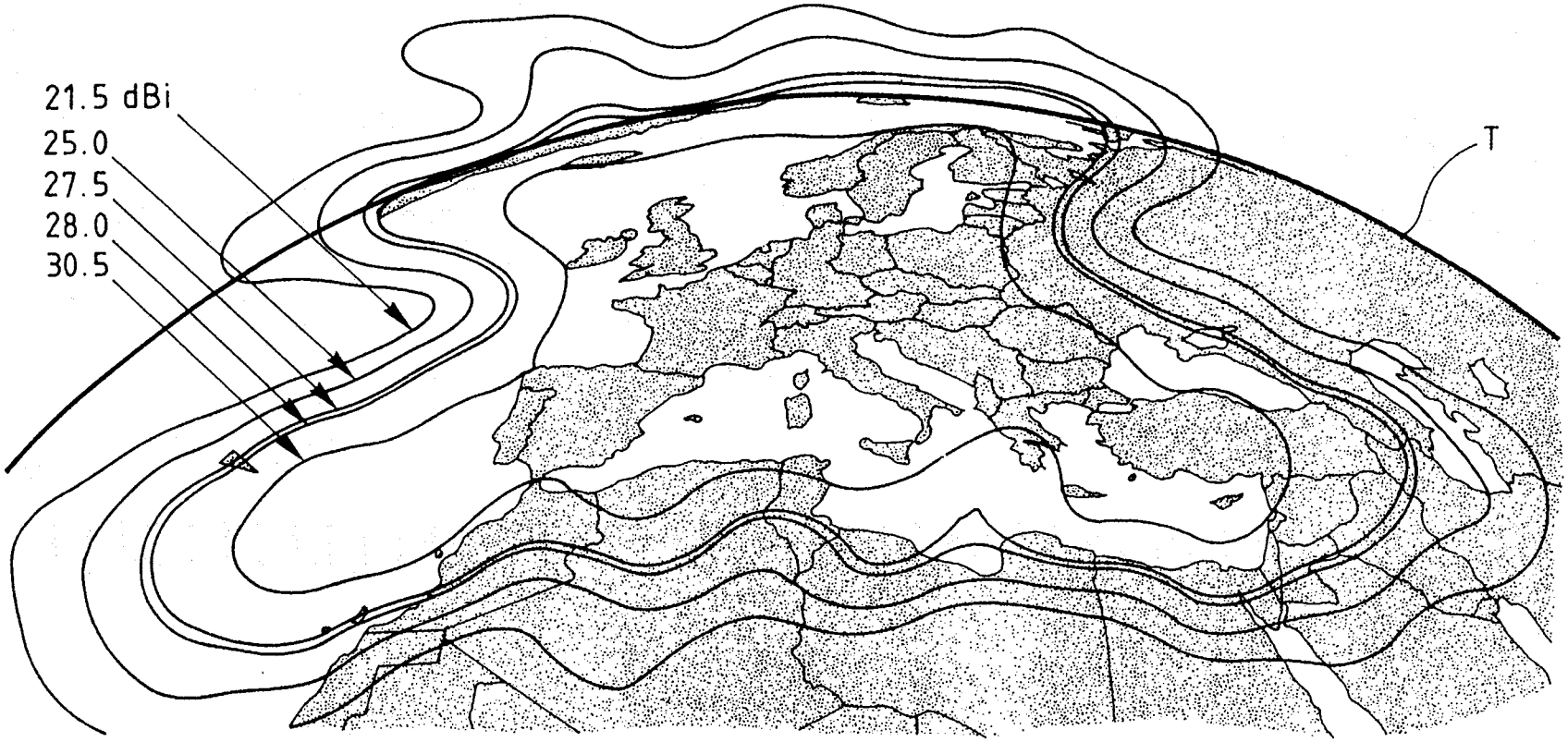
FIG. 1 shows part of the terrestrial globe centered on Europe and isopower curves associated with a shaped beam antenna.

FIG. 1 shows an example of a geographical coverage zone on the terrestrial globe T produced by a shaped beam antenna, centered on Europe and extending North as far as Scandinavia, East as far as the USSR border, South as far as North Africa and West as far as the Atlantic Ocean, including the Azores. The diagram shows various radiation isopower curves, between 21.5 dBi and 30.5 dBi.

Figure 2:
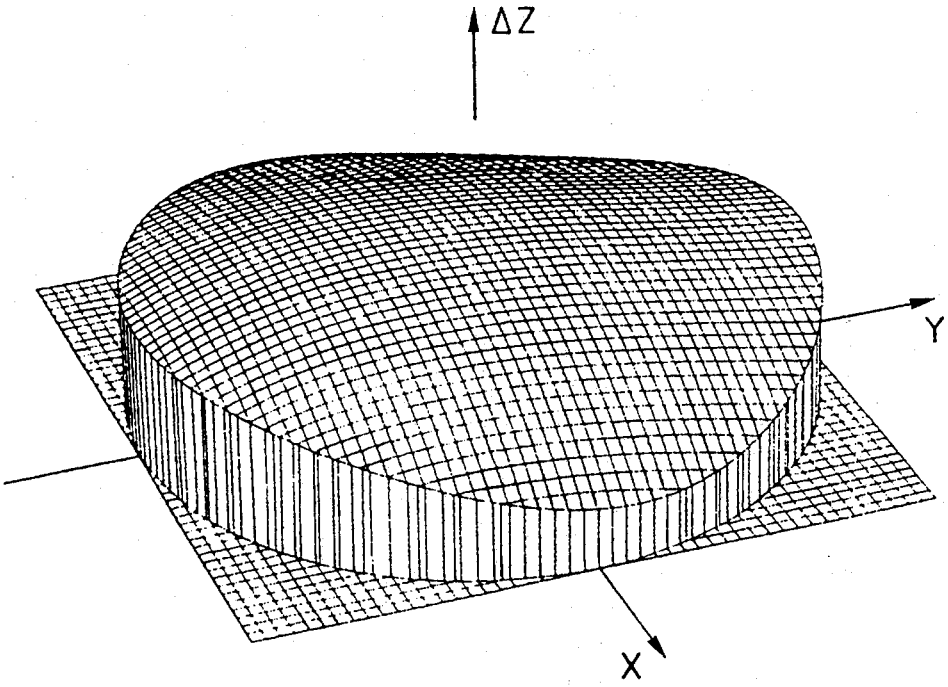
FIG. 2 is a graphical representation of the offset of the shaped surface of a typical fixed configuration antenna reflector with a reference paraboloid.

Radiation diagrams of this kind are conventionally obtained using reflectors having a deformed surface for which FIG. 2 shows the offset parallel to Z from a reference paraboloid in a simple example in an (X, Y, Z) frame of reference in which Z is at least approximately oriented in the transmit (or receive) direction.

Figure 3:
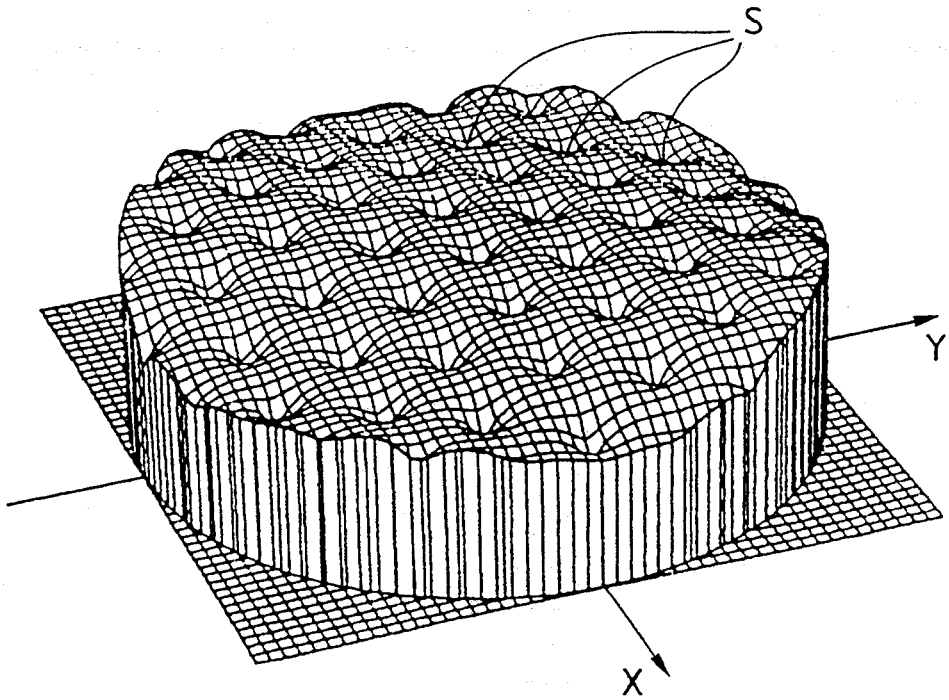
FIG. 3 is a graphical representation of the offset of the actual shaped surface of a typical known reconfigurable geometry antenna reflector with the same reference paraboloid.

Unfortunately, in the case of an in-service reconfigurable reflector the actual surface obtained by following the teachings of CLARRICOATS et al features multiple singularities, denoted S in FIG. 3, like the stitches in a quilt, and which introduce heterogeneities into the coverage zone on the ground produced by the antenna.

Figure 4:
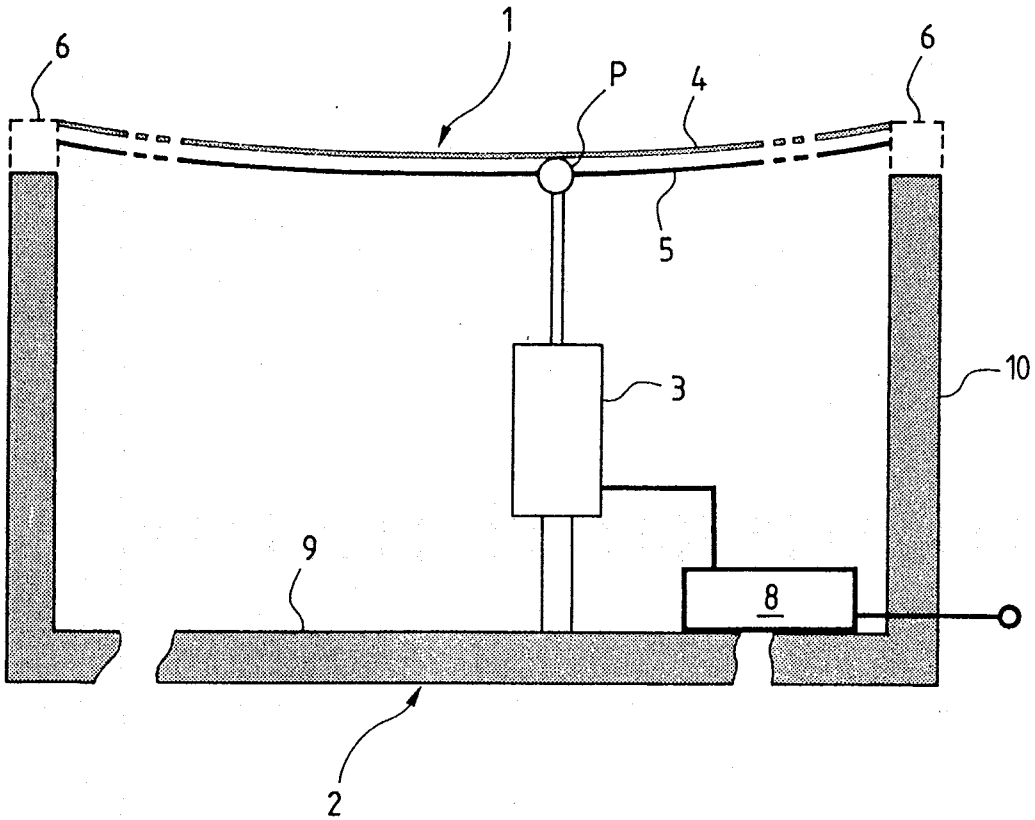
FIG. 4 is a diagrammatic representation of an in-service reconfigurable antenna reflector in accordance with the invention.

To avoid this, an antenna reflector in accordance with the invention such as that shown diagrammatically in FIG. 4 includes the following subsystems:

a deformable reflective surface or skin 1 for reflecting radio waves and having stiffness in bending;

a sandwich or mesh metal or composite material rigid support structure 2 to which the periphery of the skin 1 is fixed (here at its edge); and actuators 3 fixed to the rigid structure and coupled to the deformable surface at control points P and adapted to impart the required profile to this deformable surface.

The invention covers two situations, depending on whether the reflector is either a single-layer skin which has the radio frequency properties required to reflect radio waves and also elasticity and bending stiffness properties; or a two-layer skin (which is the usual case and is shown in FIG. 4) having a reflective surface 4 with no bending stiffness supported by a lightweight support structure or surface 5 having elastic stiffness in bending; the mechanical and radio frequency properties of the skin are therefore decoupled because they are provided by two different components.

In the former case, the reflective thin skin having stiffness in bending is typically composed of, for example:

a plastic material reinforced with electrically conductive fibers (carbon, metal, etc), for example a thin skin between 25 μm and 1 mm thick made from composite materials based on carbon fibers impregnated with thermosetting or thermoplastic resin; or a plastic material reinforced with non-conductive fibers (aramide, glass, etc) between 25 μm and 1 mm thick and covered with a vacuum-deposited or adhesively bonded metal (copper, aluminum, silver, gold, etc) film and typically between 500 Å and 50 μm thick.

In the latter case the reflective surface with little bending stiffness is, for example:

a metalized flexible plastic material film (the aluminized thermoplastic material film marketed under the trade name "KAPTON", for example);

knitted electrically conductive filaments (such as 25 μm diameter gold-plated molybdenum wire, etc) similar, for example, to the material used for in-orbit deployable reflectors; or a woven fabric of electrically conductive (metal or carbon) fibers or wires, possibly with an insulative protective sheath.

The thickness of the reflective surface 4 is typically between 25 μm and 1 mm. It is stretched on the lightweight support structure 5 which is typically a triangular or rectangular mesh of wires having stiffness in bending (metal wires or fibers of glass, KEVLAR, carbon coated with a thermosetting or thermoplastic matrix) with a typical mesh size between 30 and 300 mm or, more generally, between 10 and 1000 mm. The reflective surface can be a knitted material with a typical mesh size between 0.2 and 6 mm.

Figure 5:
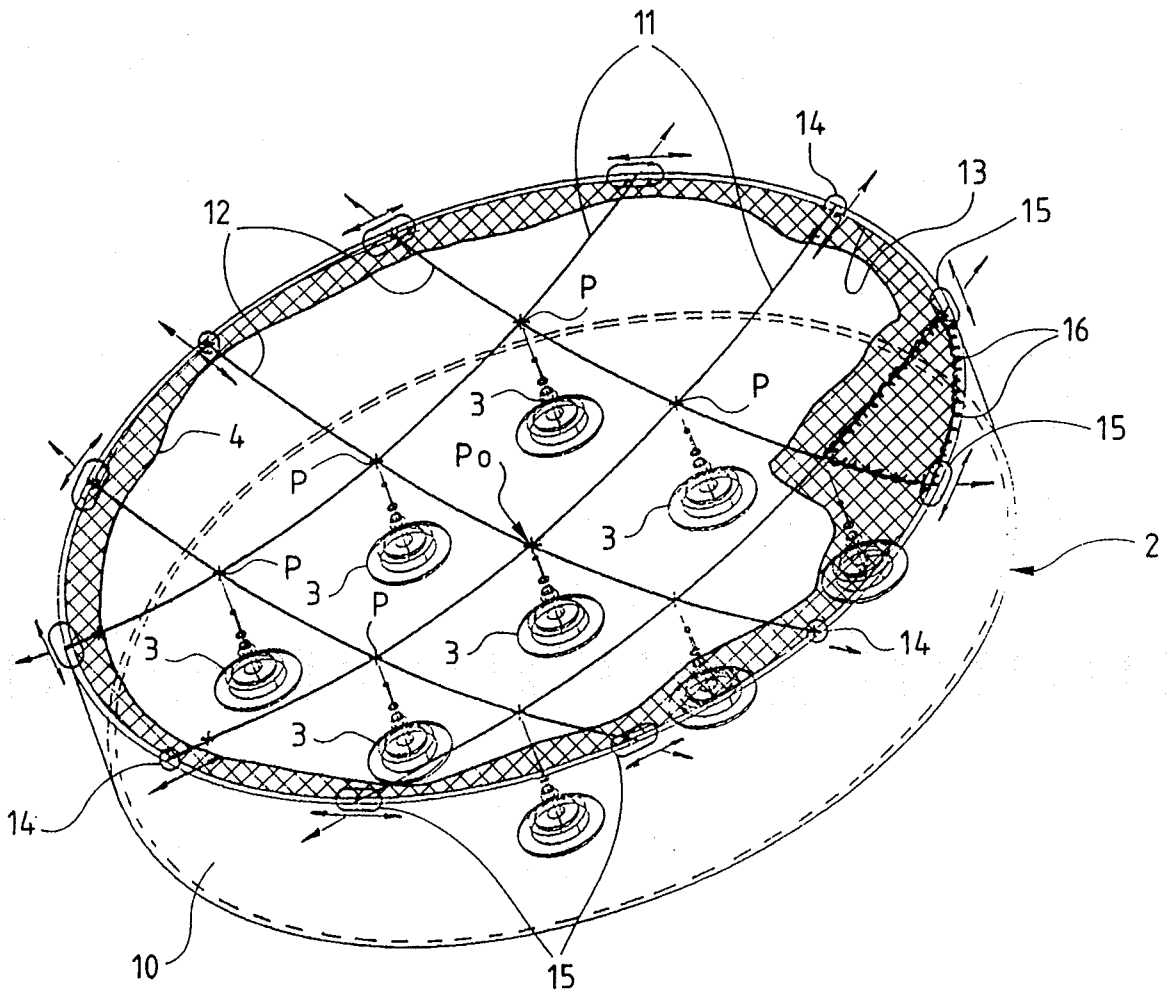
FIG. 5 is a diagrammatic perspective view of a circular contour reflector with nine control points.
Figure 7:
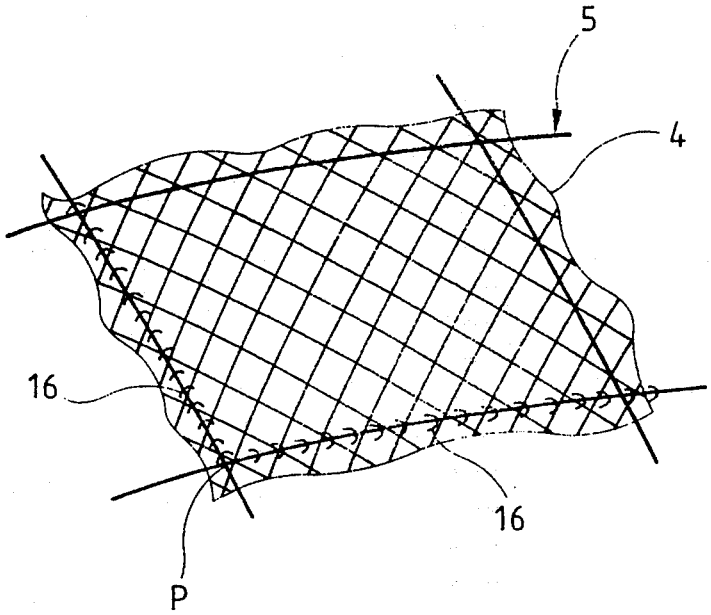
FIG. 7 is a detail view showing one mesh of the support structure and the portions of flexible surface that it supports.
Figure 6:
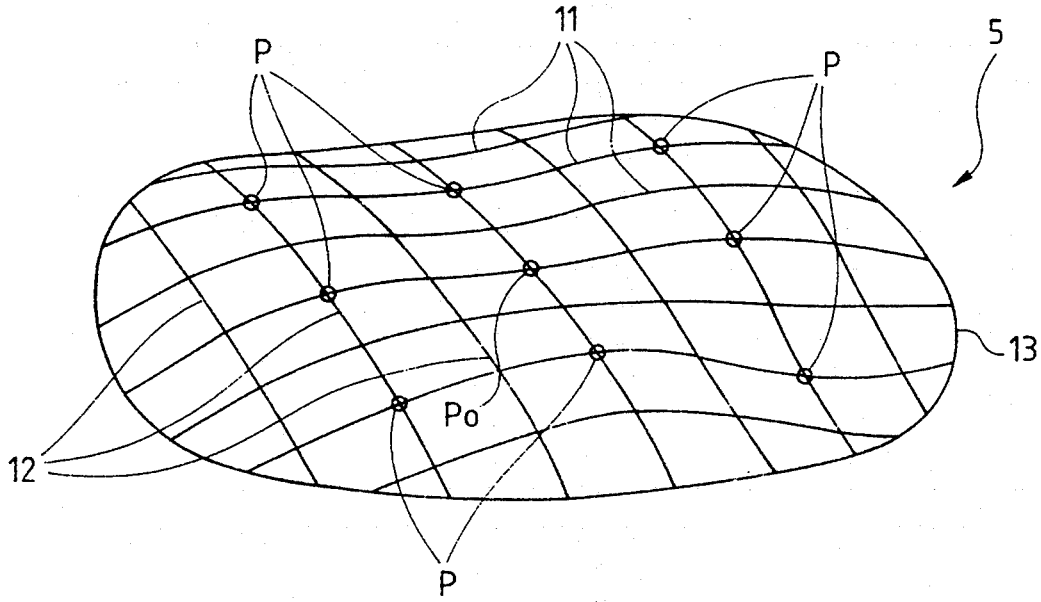
FIG. 6 is a diagrammatic perspective view of the supporting structure from FIG. 4 shown in isolation.

FIGS. 5 through 7 show one embodiment of a reflector shown in theoretical form in FIG. 4. Parts similar to those of FIG. 4 are identified by the same reference symbol.

The rigid support structure 2 has a back 9 which supports actuators and a cylindrical side wall 10 to the edge or border 13 of which, at a distance from the back 9, is fixed the periphery of the skin 1 (see reference number 6 in FIG. 4).

To be more precise, the lightweight support structure 5, shown schematically in FIG. 6, is formed by two layers 11 and 12 of criss-cross wires or strips connected near their ends to the free edge 13 of the cylindrical side wall 10 representing in physical terms the periphery 6 of the skin 1 (see FIG. 5). Any appropriate means of attachment may be used, for example holes in the cylindrical side wall 10 into which the ends of the lightweight support structure are directly inserted (in practice the curved ends of the wires constituting the structure).

In FIG. 5 the points where the free ends of the wires and the border 13 are joined are enclosed in circles 14 or ellipses 15 adjacent which are arrows, one arrow for the circles and two crossed arrows for the ellipses; this schematically represents the advantageous provision of the capability for relative movement of the connections along the wires (circles and ellipses) or even along the border 13 (ellipses). The circles or ellipses have the shape of the aforementioned holes, for example. In practice, relative movement only along the wires (circles) is sufficient for the wire(s) at the center of each layer of wires 11 or 12. This will be further explained hereinafter.

The flexible reflective surface 4 which covers the lightweight support surface 5 is affixed at its periphery to the edge 13 of the cylindrical side wall so as to be kept taut. Any appropriate attachment means may be employed, such as sewing, adhesive bonding or "VELCRO" type. fastenings, for example. Part of the attachment is shown in FIGS. 5 and 7. The wires or strips 11 and 12 are affixed to the edge 13 by any appropriate known means such as adhesive bonding or sewing with KEVLAR filaments, for example. Examples of these sewn areas along the wires are indicated at 16 in FIGS. 5 and 7. As mentioned above, the representation of this skin as a mesh is by way of example only.

In practice the control points P are disposed at at least some of the crossings of the wires 11 and 12. In FIG. 6 control points are provided for every two wires, with intermediate wires between the wires linking the control points. These intermediate wires are omitted in FIG. 5 for the sake of clarity. As an alternative, each wire crossing may be a control point, of course.

Nine control points are provided in FIGS. 5 and 6. This number can take any value, of course, the number being proportional to the precision required in respect to the geometry imposed on the skin 1.

In accordance with the invention between 4 and 100 control points are typically used per square meter.

In practice a special control point $P_o$ is chosen at the center of the skin 1 to constitute a reference point for the skin as a whole. This point $P_o$ is in practice located at the crossing of the central wires whose connections with the border 13 are surrounded with circles 14.

The reflective surface profile is established by synchronized or sequential operation of motorized actuators at the control points. There is one actuator per control point. The actuators are preferably of the linear type:

piezo-electric linear actuators, or rotary electric stepper motors connected to lead screw/nut systems.

The actuators can push and pull the reflective surface in a nearly perpendicular direction.

Nevertheless, to limit the deformation forces and energy that could be generated by the variations of length developed at the surface between two consecutive control points, rotational degrees of freedom are advantageously introduced by universal joint type couplings, either between the rear structure and the actuators, or between the actuators and the "skin".

Figure 8:
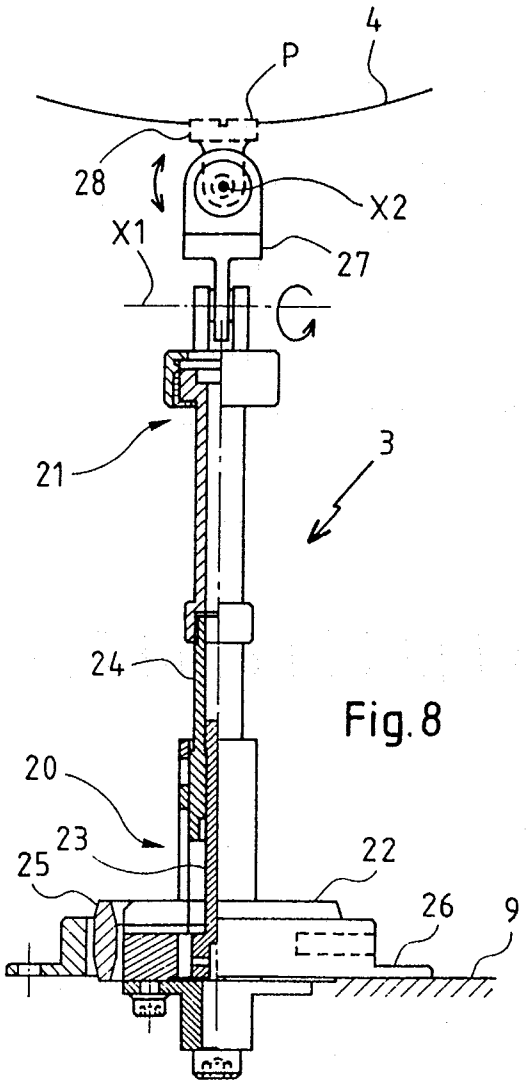
FIG. 8 is a view in partial cross-section of an actuator.

FIG. 8 shows in partial cross section a preferred embodiment of an actuator 3 having degrees of freedom in rotation where it is attached to the back 9 of the support structure 2 and to a control point P.

The actuator has a driving part 20 joined to the back 9 and a driven part 21 joined to the point P. The driving part 20 is a motor 22 controlled in any appropriate known manner through a control circuit 8 (FIG. 4) and a screw 23 adapted to be rotated but fixed against axial movement. The driven part 21 includes a tubular portion 24 forming a nut which is free to move in the axial direction relative to the driving part but which is coupled rotationally to the latter.

The base of the driving part is coupled by a universal joint 25 to a fixing flange 26 screwed to the back 9. Two degrees of freedom in rotation are therefore provided about axes transverse to the actuator.

The upper section of the driven part 21 carries a stirrup member 27 which pivots about a first transverse axis X1. Mounted in the stirrup member to pivot about a second axis X2 perpendicular to the first axis is a coupling part 28 attached to the point P.

Figure 9:
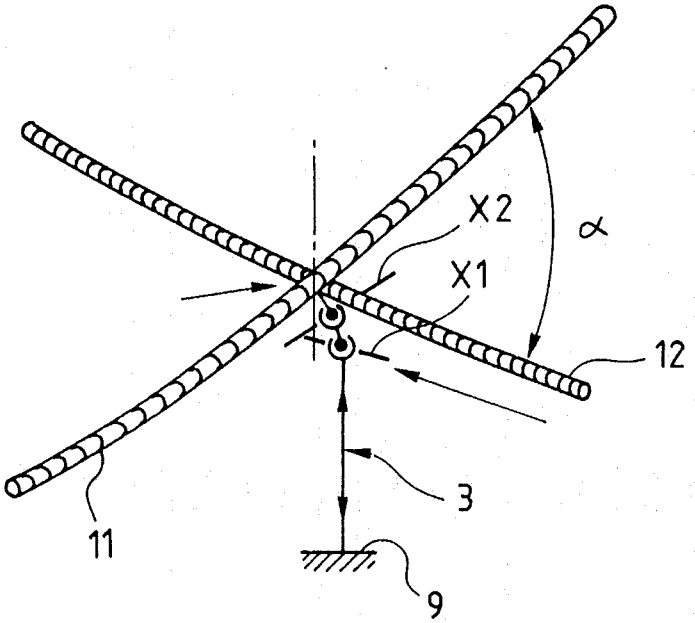
FIG. 9 is a diagrammatic representation of the coupling of the actuator to the crossover of two wires of the support structure.

The combination of these degrees of freedom in rotation permits relative movement of the point P parallel to the support surface 5 by virtue of (moderate) inclination of the actuator. This type of actuator is particularly advantageous if, as in the case of FIG. 9, the wires 11 and 12 which cross at point P are joined together with (or without) the possibility of relative rotational movement $\alpha$ or if the skin is a single-layer skin.

In most cases the stirrup member alone is sufficient to provide sufficient relative movement at point P. The universal joint 25 at the base of the actuator may then with advantage be replaced by a rigid joint with no degrees of freedom.

In the case of a mesh skin, these degrees of freedom in rotation may be replaced by degrees of freedom in translation. The wires can slide independently of each other relative to the control points.

At the reference control point $P_o$ it is not necessary to provide any degree of freedom in translation; consequently, there is no utility in providing either the universal joint 25 at its base or the pivoting stirrup member 27 for the actuator connected to this point $P_o$.

Figure 10:
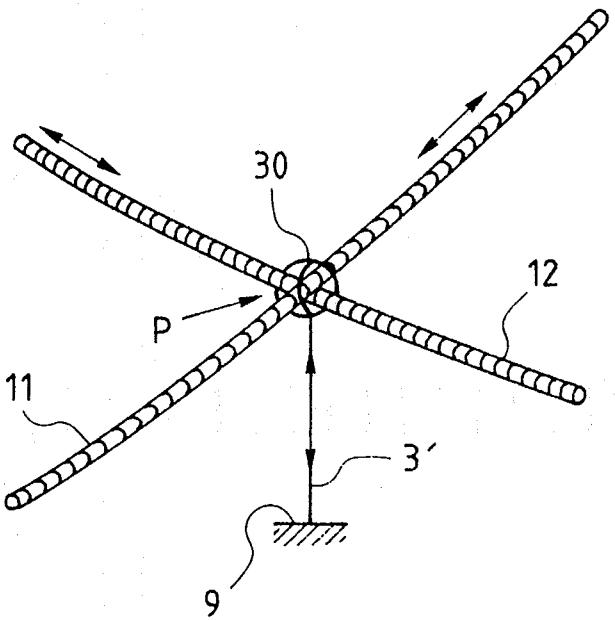
FIG. 10 is a similar view to FIG. 9 with a simplified actuator and wires mobile relative to each other.

This situation is shown in FIG. 10 in which the schematically represented actuator 3' has in its upper part two rings 30 in which the respective wires 11 and 12 slide freely. This simplifies the structure of the actuator which no longer requires any degrees of freedom in rotation.

For the same reasons, the rigid elements of the skin such as the wires or the composite material surfaces must be able to slide on the contour of the reflector.

It is for this reason that the ellipses 15 from FIG. 5 are provided. The connections schematically represented by the circles 14 can be implemented as circular holes whereas the connections with two degrees of freedom in translation schematically represented by the ellipses 15 may be implemented as oblong holes localized in the rigid support structure near the contour of the reflective surface.

To give a numerical example:

the reflective skin is knitted from gold-plated molybdenum wires 25 μm thick;

the underlying support structure is a grid of glass fibers in an epoxy resin matrix with a rectangular mesh size of 160×175 mm and a filament diameter of 3 mm;

the area of the skin is 1.6 $m^2$;

there are 45 control points; and the actuators have a maximum travel of 15 mm.

Figure 11:
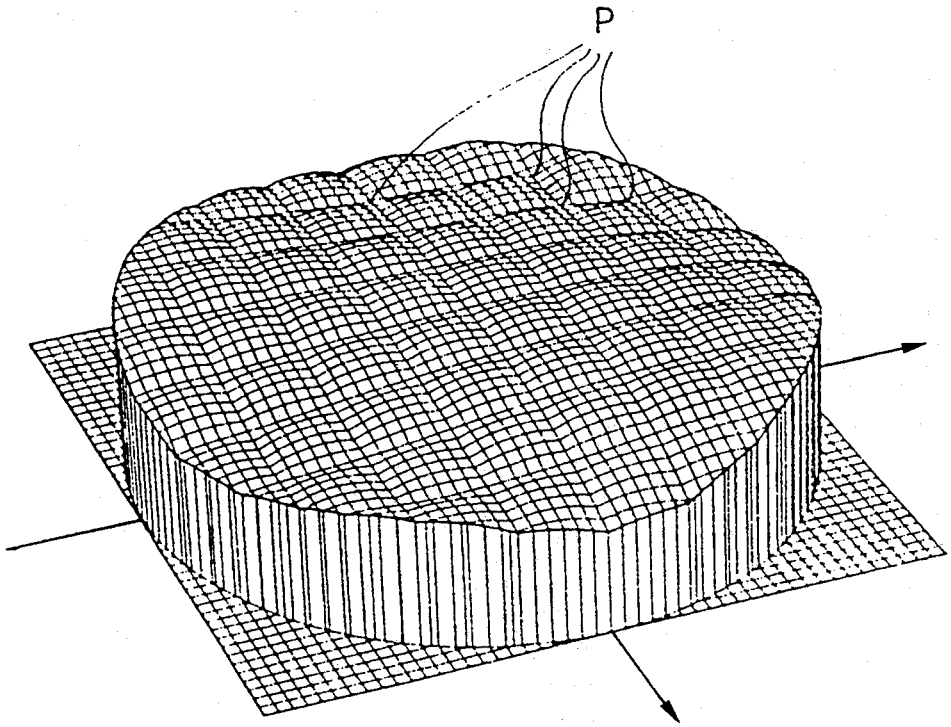
FIG. 11 is a graphical representation of the offset of the actual shaped surface of a reflector in accordance with the invention with a reference paraboloid.

FIG. 11 shows one example of the resulting surface geometry. Note that there are depressions at the control points P, but these are much less marked than in the prior art of which FIG. 3 is a representative example.

It should be understood that the invention is not concerned with the theoretical determination of the geometry to be conferred upon one or more reflectors to obtain a beam having the required contour, but rather the structure required of the reflector in order to be able to implement the given geometry.

It goes without saying that the foregoing description has been given by way of non-limiting example only and that numerous variants may be proposed by one skilled in the art without departing from the scope of the invention.

There is claimed:

1. A reconfigurable antenna reflector comprising:

a rigid support structure;

a reflective surface attached to said rigid support structure, said reflective surface having radio reflection properties, said reflective surface further being elastically deformable with stiffness in bending;

means for deforming said reflective surface mounted between said rigid support structure and said reflective surface, said deforming means being a plurality of piezoelectric linear actuators operating on predetermined points of said reflective surface; and means for pivotably connecting said deforming means to said rigid support structure.

2. The reconfigurable antenna reflector according to claim 1 wherein said reflective surface comprises a layer of polymer material reinforced with fibers.

3. A reconfigurable antenna reflector according to claim 2 wherein said fibers are electrically conductive.

4. The reconfigurable antenna reflector according to claim 2 wherein said fibers are electrically non-conductive and said layer is covered with a metal film.

5. The reconfigurable antenna reflector according to claim 4 wherein said metal film is a vacuum-deposited metal film.

6. The reconfigurable antenna reflector according to claim 4 wherein said metal film is adhesively bonded to said layer.

7. The reconfigurable antenna reflector according to claim 1 wherein said reflective surface comprises a composite material of carbon fibers impregnated with a thermosetting resin.

8. The reconfigurable antenna reflector according to claim 1 wherein said reflective surface comprises a flexible reflective layer and an elastically deformable support layer supporting said flexible reflective layer, said elastically deformable support layer having stiffness in bending.

9. The reconfigurable antenna reflector according to claim 8 wherein said elastically deformable support layer comprises a grid of elongate elements having stiffness in bending.

10. The reconfigurable antenna reflector according to claim 9 wherein said elongate elements are metal wires.

11. The reconfigurable antenna reflector according to claim 9 wherein said elongate elements are fibers coated with a polymer material.

12. The reconfigurable antenna reflector according to claim 9 wherein said grid has a mesh size of between about 10 mm and about 1 m.

13. The reconfigurable antenna reflector according to claim 8 wherein said flexible reflective layer is a metalized flexible polymer material film.

14. The reconfigurable antenna reflector according to claim 8 wherein said flexible reflective layer is a knit formed from electrically conductive wire.

15. A reconfigurable antenna reflector according to claim 8 wherein said flexible reflective layer is a weave formed from an electrically conductive material.

16. The reconfigurable antenna reflector according to claim 1 further comprising second means for pivotably connecting said deforming means to said reflective surface, said second connecting means being rotatable about two axes which are substantially parallel to said reflective surface.

17. The reconfigurable antenna reflector according to claim 1 wherein said reflective surface comprises:

a reflective layer which is flexible in bending; and a support layer for supporting said reflective layer, said support layer having a plurality of wires defining a grid and imposing stiffness in bending;

wherein said deforming means operates on said reflective surface at corresponding predetermined points of said support layer, said corresponding predetermined points being located at intersections between said plurality of wires.

18. The reconfigurable antenna reflector according to claim 17 wherein a respective deforming means is associated with each said intersection between said plurality of wires.

19. The reconfigurable antenna reflector according to claim 1 wherein said reflective surface comprises a layer of polymer material reinforced with fibers.

20. The reconfigurable antenna reflector according to claim 19 wherein said fibers are electrically conductive.

21. The reconfigurable antenna reflector according to claim 19 wherein said fibers are electrically nonconductive and said reflective surface is covered with a metal film.

22. The reconfigurable antenna reflector according to claim 21 wherein said metal film is a vacuum-deposited metal film.

23. The reconfigurable antenna reflector according to claim 21 wherein said metal film is adhesively bonded to said reflective surface.

24. The reconfigurable antenna reflector according to claim 1 wherein said reflective surface comprises a composite material of carbon fibers impregnated with a thermosetting resin.

25. A reconfigurable antenna reflector comprising:

a rigid support structure;

a reflective layer attached to said rigid support structure, said reflective layer having radio reflective properties, said reflective layer comprising a flexible reflective surface layer and an elastically deformable support surface layer contiguously mounted to said flexible reflective surface layer, said elastically deformable support surface layer having stiffness in bending, said elastically deformable support surface layer further comprising a grid of elongate elements having stiffness in bending, said grid being secured at its periphery to said rigid support structure such that said elongate elements are connected to said rigid support structure with at least freedom to move in a parallel direction thereto, said grid of elongate elements further communicating with said flexible reflective surface layer over substantially all of its contiguous surface area; and means for deforming said reflective layer mounted between said rigid support structure and said reflective layer, said deforming means comprising at least one rotary motor, at least one lead screw attached to said at least one rotary motor, and at least one nut mounted to said at least one lead screw such that said at least one lead screw operates on a predetermined point of said reflective layer.

26. The reconfigurable antenna reflector according to claim 25 wherein said elongate elements are metal wires.

27. The reconfigurable antenna reflector according to claim 25 wherein said elongate elements are fibers coated with a polymer material.

28. The reconfigurable antenna reflector according to claim 27 wherein said fibers are formed from a material selected from the group consisting of glass, aramide and carbon.

29. The reconfigurable antenna reflector according to claim 25 wherein said grid has a mesh size of between about 10 mm and about 1 m.

30. The reconfigurable antenna reflector according to claim 25 wherein said reflective layer comprises a layer of polymer material reinforced with fibers.

31. The reconfigurable antenna reflector according to claim 30 wherein said fibers are electrically conductive.

32. The reconfigurable antenna reflector according to claim 30 wherein said fibers are electrically nonconductive and said reflective layer is covered with a metal film.

33. The reconfigurable antenna reflector according to claim 32 wherein said metal film is a vacuum-deposited metal film.

34. The reconfigurable antenna reflector according to claim 32 wherein said metal film is adhesively bonded to said reflective layer.

35. The reconfigurable antenna reflector according to claim 25 wherein said reflective layer comprises a composite material of carbon fibers impregnated with a thermosetting resin.

36. A reconfigurable antenna reflector comprising:

a rigid support structure;

a reflective surface attached to said rigid support structure, said reflective surface having radio reflection properties, said reflective surface comprising:

a reflective layer which is flexible in bending;

a support layer for supporting said reflective layer, said support layer having a plurality of wires defining a grid and imposing stiffness in bending; and means for deforming said reflective surface, said deforming means being mounted between said rigid support structure and said reflective surface, said deforming means operating on said reflective surface at corresponding predetermined points of said reflective surface, said predetermined points being intersections between said plurality of wires, said means for deforming comprising at least one ring in which two wires of said plurality of wires cross and slide freely.

37. The reconfigurable antenna reflector according to claim 36 wherein said reflective surface comprises a layer of polymer material reinforced with fibers.

38. The reconfigurable antenna reflector according to claim 37 wherein said fibers are electrically conductive.

39. The reconfigurable antenna reflector according to claim 37 wherein said fibers are electrically nonconductive and said reflective layer is covered with a metal film.

40. The reconfigurable antenna reflector according to claim 39 wherein said metal film is a vacuum-deposited metal film.

41. The reconfigurable antenna reflector according to claim 39 wherein said metal film is adhesively bonded to said reflective layer.

42. The reconfigurable antenna reflector according to claim 36 wherein said reflective surface comprises a composite material of carbon fibers impregnated with a thermosetting resin.

* * * * *

UNITED STATES PATENT AND TRADEMARK OFFICE

CERTIFICATE OF CORRECTION

PATENT NO. : 5,440,320

DATED : August 8, 1995

INVENTOR(S) : Serge Schenck and Oliver Lach

It is certified that error appears in the above-indentified patent and that said Letters Patent is hereby corrected as shown below:

Column 1, line 23, delete "shaped" insert ---- shape ----.

Column 1, line 39, delete "pat" insert ---- path ----.

Column 5, line 32, delete "type." insert ---- type ----.

Column 7, line 44, delete "A" insert ---- The ----.

Column 8, line 15, delete "A" insert ---- The ----.

Signed and Sealed this

Seventeenth Day of October, 1995

*Attest:*

Bruce Lehman

BRUCE LEHMAN

*Attesting Officer*

*Commissioner of Patents and Trademarks*